US009927164B2

(12) United States Patent
Eckartsberg et al.

(10) Patent No.: US 9,927,164 B2
(45) Date of Patent: Mar. 27, 2018

(54) REFRIGERATION DEVICE AND METHOD FOR PRODUCING THE SAME

(75) Inventors: Peter Eckartsberg, Aalen (DE); Michael Fahrenbach, Seligenstadt (DE)

(73) Assignee: BSH Hausgeräte GmbH, Munich (DE)

( * ) Notice: Subject to any disclaimer, the term of this patent is extended or adjusted under 35 U.S.C. 154(b) by 536 days.

(21) Appl. No.: 13/816,505

(22) PCT Filed: Aug. 15, 2011

(86) PCT No.: PCT/EP2011/064014

§ 371 (c)(1),
(2), (4) Date: Feb. 12, 2013

(87) PCT Pub. No.: WO2012/028446

PCT Pub. Date: Mar. 8, 2012

(65) Prior Publication Data

US 2013/0139540 A1 Jun. 6, 2013

(30) Foreign Application Priority Data

Aug. 31, 2010 (DE) ..... 10 2010 040 076

(51) Int. Cl.

| | |
|---|---|
| ***F25D 11/00*** | (2006.01) |
| ***F25D 23/06*** | (2006.01) |
| ***F25D 23/00*** | (2006.01) |
| *F25D 25/02* | (2006.01) |
| *F25B 39/02* | (2006.01) |

(52) U.S. Cl.

CPC ..... *F25D 11/00* (2013.01); *F25D 23/006* (2013.01); *F25D 23/061* (2013.01); *F25D 23/067* (2013.01); *F25B 39/02* (2013.01); *F25D 25/028* (2013.01); *Y10T 29/49359* (2015.01)

(58) Field of Classification Search

CPC ..... F25D 11/00; F25D 23/006; F25D 23/061; F25D 23/067; F25D 25/028

USPC ..... 62/440, 443, 444, 516, 518, 526

See application file for complete search history.

(56) References Cited

U.S. PATENT DOCUMENTS

| | | | | |
|---|---|---|---|---|
| 2,073,741 A | | 3/1937 | Gibson | |
| 2,356,068 A | | 8/1944 | Larsson | |
| 2,516,586 A | * | 7/1950 | Peltier | F25B 39/02 165/172 |

(Continued)

FOREIGN PATENT DOCUMENTS

| | | |
|---|---|---|
| CN | 101321998 A | 12/2008 |
| CN | 201166492 Y | 12/2008 |

(Continued)

OTHER PUBLICATIONS

Search Report dated Jun. 4, 2014 in Chinese Application No. 201180040981.7 (2 pages).

(Continued)

*Primary Examiner* — Frantz Jules
*Assistant Examiner* — Joseph Trpisovsky
(74) *Attorney, Agent, or Firm* — Nixon & Vanderhye, P.C.

(57) ABSTRACT

A refrigeration appliance includes a refrigerated goods container having an interior. Disposed on the refrigerated goods container outside the interior is a first tube evaporator which is wound round the refrigerated goods container, and a second tube evaporator is disposed on the refrigerated goods container in a top region thereof inside the interior.

32 Claims, 8 Drawing Sheets

(56) References Cited

U.S. PATENT DOCUMENTS

| | | | | | |
|---|---|---|---|---|---|
| 2,524,465 | A * | 10/1950 | Morrison | 62/80 | |
| 2,725,727 | A * | 12/1955 | Moore | F25D 25/028 | 62/331 |
| 2,932,955 | A * | 4/1960 | Hargrave et al. | 62/255 | |
| 6,997,011 | B2 * | 2/2006 | Gerstner et al. | 62/515 | |
| 2003/0196783 | A1 * | 10/2003 | Reagen | F25B 39/02 | 165/144 |
| 2007/0033962 | A1 * | 2/2007 | Kang et al. | 62/441 | |
| 2008/0202141 | A1 * | 8/2008 | Lim et al. | 62/285 | |
| 2010/0031684 | A1 * | 2/2010 | Spiller | 62/259.1 | |
| 2011/0011120 | A1 * | 1/2011 | Pocajt et al. | 62/440 | |

FOREIGN PATENT DOCUMENTS

| | | | | |
|---|---|---|---|---|
| CN | 101566415 | A | 10/2009 | |
| CN | 201463449 | U | 5/2010 | |
| DE | 737605 | C | 7/1943 | |
| DE | 10 2005 057 157 | A1 | 5/2007 | |
| EP | 0 534 107 | A1 | 3/1993 | |
| EP | 1 624 265 | A1 | 2/2006 | |
| GB | 847293 | | 9/1960 | |
| GB | 982399 | A * | 2/1965 | F25D 23/067 |
| WO | 2010133069 | A1 | 11/2010 | |

OTHER PUBLICATIONS

International Search Report PCT/EP2011/064014 dated Nov. 22, 2012.

* cited by examiner

REFRIGERATION DEVICE AND METHOD FOR PRODUCING THE SAME

This application is a U.S. National Phase of International Patent Application No. PCT/EP2011/064014, filed Aug. 15, 2011, which designates the U.S. and claims priority to German Patent Application No. DE 10 2010 040 076.9, filed Aug. 31, 2010, the entire contents of each of which are hereby incorporated by reference.

BACKGROUND OF THE INVENTION

The present invention relates to a refrigeration appliance having a refrigerated goods container and a method for producing a refrigeration appliance.

In refrigeration appliances a refrigerant is generally conducted in a closed circuit. The refrigerant is first compressed by a compressor, condensed in a first heat exchanger as it emits heat, expanded by means of a throttle and evaporated at low temperature in a second heat exchanger as it absorbs heat. Second heat exchangers in the form of tube evaporators are known, which are wound round the outside of a refrigerated goods container fastened in an outer housing. A thermally insulating foam can be provided between the refrigerated goods container and the outer housing. During operation the tube evaporator absorbs heat through the refrigerated goods container, causing the space inside the refrigerated goods container to be cooled.

However an uneven temperature distribution can result in the refrigerated goods container during operation. Depending on the size of the refrigerated goods container this can result in temperature gradients of several degrees Celsius. However there is a requirement to maintain a defined maximum temperature depending on the refrigeration appliance. It may therefore be desirable in the case of frozen goods containers or freezer appliances for the temperature in the refrigeration appliance not to be higher than −18° C. The temperature gradient means that individual regions, e.g. the base region, are cooled to a lower temperature, e.g. −22° C. Such an uneven temperature distribution means that the energy consumption of the refrigeration appliance is higher than would be the case if the temperature distribution were even.

BRIEF SUMMARY OF THE INVENTION

The object of the invention is therefore to provide a refrigeration appliance which has reduced energy consumption.

A refrigeration appliance refers in particular to a household refrigeration appliance, in other words a refrigeration appliance used for household management in households or possibly also in the field of gastronomy, which serves in particular to store food and/or beverages in normal domestic quantities at defined temperatures, for example a refrigerator, a freezer or a combined fridge/freezer.

The object is achieved by a refrigeration appliance as claimed by the invention. The refrigeration appliance comprises a refrigerated goods container having an interior, a first tube evaporator, which is disposed on the refrigerated goods container outside the interior, and a second tube evaporator, which is disposed on the refrigerated goods container inside the interior.

It is thus possible to achieve an even temperature distribution inside the refrigerated goods container. By providing a second temperature evaporator inside the refrigerated goods container it is possible to compensate for temperature differences in the refrigerated goods container, so that the interior of the refrigerated goods container can be cooled precisely to the specified maximum temperature. The standard energy consumption of the appliance is thus reduced.

The first tube evaporator can be wound round the refrigerated goods container. This results in relatively even cooling of the interior of the refrigerated goods container.

The second tube evaporator can be disposed in a top region of the refrigerated goods container, in particular on a top wall. The uneven temperature distribution that occurs without the second tube evaporator is due to the fact that cooler air moves downward so there is a lower temperature in the base region of the refrigerated goods container than in the top region. The provision of the second temperature evaporator in the top region therefore allows a more even temperature to be achieved in the interior. The top region here refers to the space in the refrigerated goods container close to the top wall, in other words for example the region at a distance of up to ⅕ or preferably 1/10 of the height of the refrigerated goods container from the top wall. The top wall here is the wall of the refrigerated goods container located at the top during use.

The second tube evaporator can be fastened to the refrigerated goods container by means of latching devices, in particular by means of clips. The second tube evaporator can thus be fastened in place with little outlay and material.

The second tube evaporator can be fastened to at least one strip, which is fastened to a top wall of the refrigerated goods container at a predefined distance from the top wall by means of latching devices, in particular clips. It is thus possible to ensure an advantageous cold circulation inside the refrigerated goods container.

The second tube evaporator can be fastened to the top wall by means of two strips at a distance from one another. This means that short strips can be used, allowing flexible fastening with little material outlay.

The at least one strip can have a lip, which rests against the top wall in a tensioned manner. This compensates for tolerances and prevents the strip flapping against the top wall.

Thermally insulating foam can be disposed between the refrigerated goods container and a wall of the refrigeration appliance. The refrigerated goods container can be closed at the front by means of a door supported on the appliance outer wall.

The first tube evaporator and the second tube evaporator can be connected to one another for flow purposes, in particular connected to one another in a serial manner for flow purposes. Both tube evaporators are thus operated by way of just one cooling circuit and no further compressors, valves or the like have to be provided for the additional evaporator.

The refrigerated goods container can be disposed for example in the interior of the refrigeration appliance.

A method for producing such a refrigeration appliance has the following steps:

disposing a first tube evaporator on the refrigerated goods container outside the interior; and disposing a second tube evaporator on the refrigerated goods container inside the interior.

There is no restriction in respect of the sequence in which the method steps are performed. It is possible to achieve the advantages set out above by providing a second tube evaporator. The second tube evaporator can be fastened to a top wall of the refrigerated goods container by means of latching devices or clips.

The method can have the following further steps:

surrounding the refrigerated goods container with a thermally insulating foam material;

after applying the foam, detaching the second tube evaporator from the latching devices;

fastening the second tube evaporator to at least one strip; and fastening the strip by means of the latching devices.

With this method the second tube evaporator is inserted before the foam application and all soldering operations on the second tube evaporator can be performed before the foam application. Also the second tube evaporator is first fastened to the top wall with clips and then the strip is fastened to the top wall with the same clips. There is therefore no need to provide separate fastening means for the second tube evaporator and the strip.

The second tube evaporator can rest against a top wall of the refrigerated goods container during the foam application. This prevents the pressure produced by the foam application deforming the top wall and causing it to bulge. During the foam application a foam core can be disposed in the refrigerated goods container, with the lower face of the second tube evaporator being supported on the foam core. The pressure produced by the foam application is thus deflected by the top wall onto the second tube evaporator and from this by way of the foam core to the base of the refrigerated goods container or a support disposed below it.

BRIEF DESCRIPTION OF THE DRAWINGS

Further exemplary embodiments are described with reference to the accompanying drawings, in which.

DETAILED DESCRIPTION OF EXEMPLARY EMBODIMENTS OF THE PRESENT INVENTION

Figure 1:
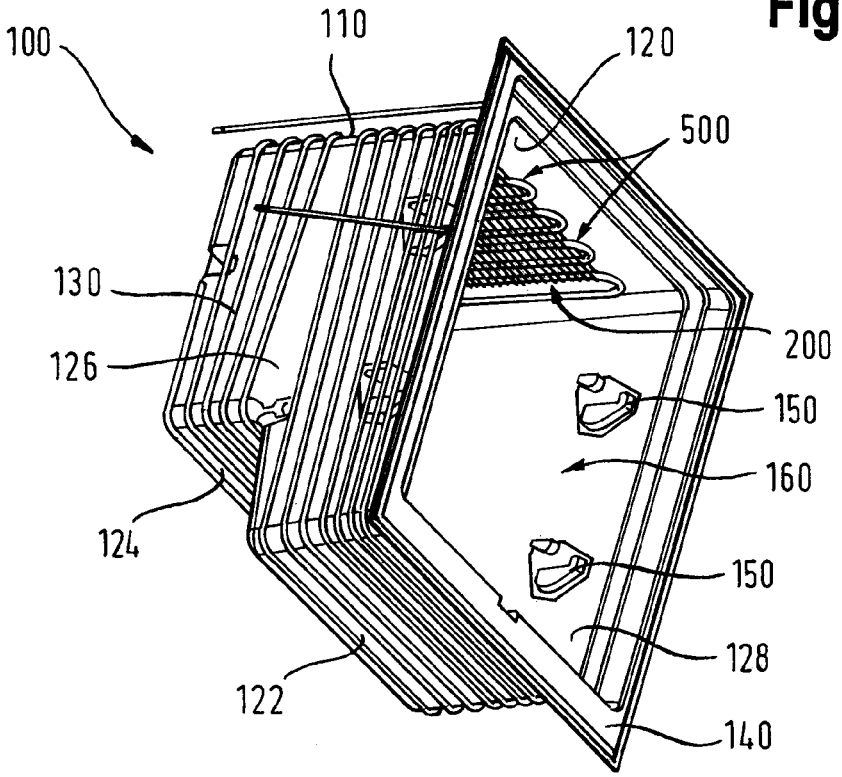
FIG. 1 shows a perspective view of a refrigerated goods container of a refrigeration appliance.

Unless otherwise stated, identical reference characters designate identical elements or those of identical function in the figures.

FIG. 1 shows a perspective view of a refrigerated goods container 110 of a refrigeration appliance 100, round which a tube evaporator 130 is wound. The refrigerated goods container 110 essentially has the form of a cuboid that is open at the front and truncated at the rear, having a top wall 120, base walls 122 and 124, left and right side walls 126 and 128 and a stepped rear wall, all defining an interior 160. The refrigerated goods container 110 can be made of plastic for example. The open front face of the refrigerated goods container 110 is surrounded by a frame 140. Provided in the side walls respectively are two detents 150, which can be used to hold separating walls to divide the refrigerated goods container vertically.

Wound round the refrigerated goods container 110 is a first tube evaporator 130, which is disposed outside the refrigerated goods container 110. During operation the first tube evaporator 130 is supplied with a refrigerant, which evaporates as it absorbs heat. In this process the first tube evaporator 130 absorbs heat through the refrigerated goods container 110, causing the interior of the refrigerated goods container 110 to be cooled.

Figure 2:
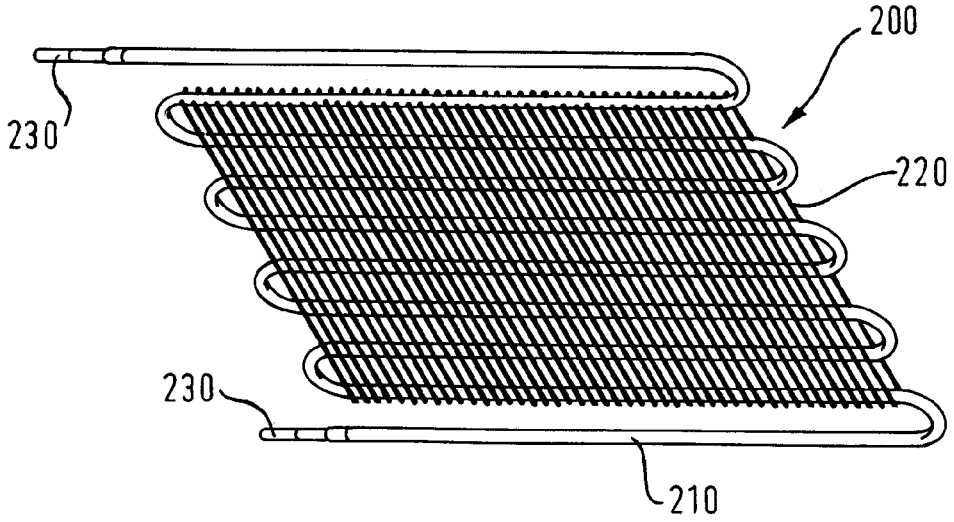
FIG. 2 shows a perspective view of a tube evaporator.

Provided inside the refrigerated goods container 110 and in the present example in the top region, in other words close to the top wall 120, is a second tube evaporator 200 in the form of a rack, shown in a perspective view in FIG. 2. The second tube evaporator 200 comprises an evaporator tube 210 and a plurality of transverse ribs 220. The evaporator tube 210 comprises for example ten straight tube segments, two of which are connected respectively at their ends by curved tube segments, so that the evaporator tube 210 extends in a wave-like manner in one plane. The transverse ribs 220 are configured for example as straight wire pieces and are disposed on both sides of the evaporator tube 210 and fastened thereto by soldering or the like. The transverse ribs 220 here extend between the second and penultimate tube segment, so that the distance between the two tube ends 230 can be changed easily by compression or extension and the two tube ends 230 can easily be rotated out of the plane defined by the transverse ribs 220. The transverse ribs 220 hold the tube segments together so that the evaporator tube 210 has a certain rigidity. They also improve the heat exchange properties of the evaporator tube 210.

The provision of the second tube evaporator 200 allows a more even temperature distribution to be achieved inside the refrigerated goods container 110, which reduces the standard energy consumption of the refrigeration appliance. The first tube evaporator 130 and the second tube evaporator 200 can be connected together in series here for flow purposes. Both tube evaporators 130, 200 are thus operated by way of just one cooling circuit and no further compressors, valves or the like have to be provided for the additional evaporator. On the input side the tube evaporators 130, 200 can be connected to a throttle valve (not shown) and on the output side they can be connected to a compressor, for example a linear compressor (not shown).

Figure 3:
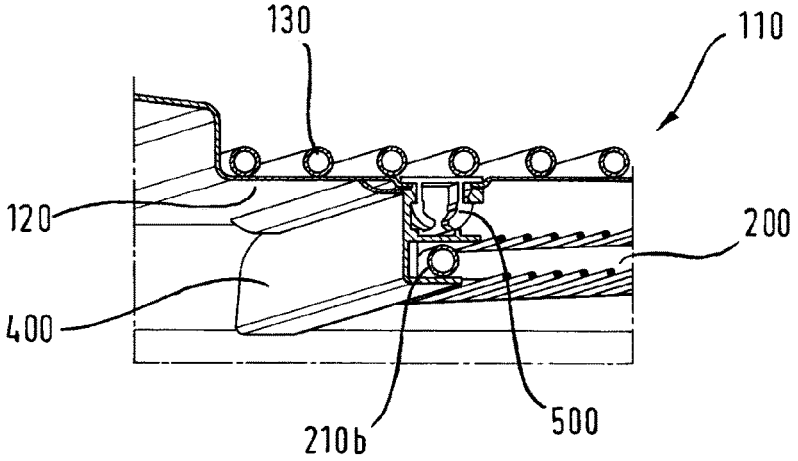
FIG. 3 shows a perspective sectional view through the refrigeration appliance.

FIG. 3 shows a perspective sectional view through a refrigeration appliance 100, the section running in a direction perpendicular to the first tube evaporator 130. In this refrigeration appliance 100 the second tube evaporator 200 is fastened by means of a strip 400 and latching devices, e.g. clips 500, to the top wall 120 in the front region of the refrigerated goods container 110. This strip 400 can be for example 400 to 520 mm long, 30 to 35 mm wide and 25 to 30 mm high.

As shown in FIG. 3, the second evaporator tube 210 is inserted into the strip 400, which in turn is inserted into the clips 500 provided in the top region. The advantage of this arrangement is that the second evaporator tube 210 is held at a predefined distance from the top wall 120. This ensures better cold circulation in the refrigeration appliance 100.

Figure 4A:
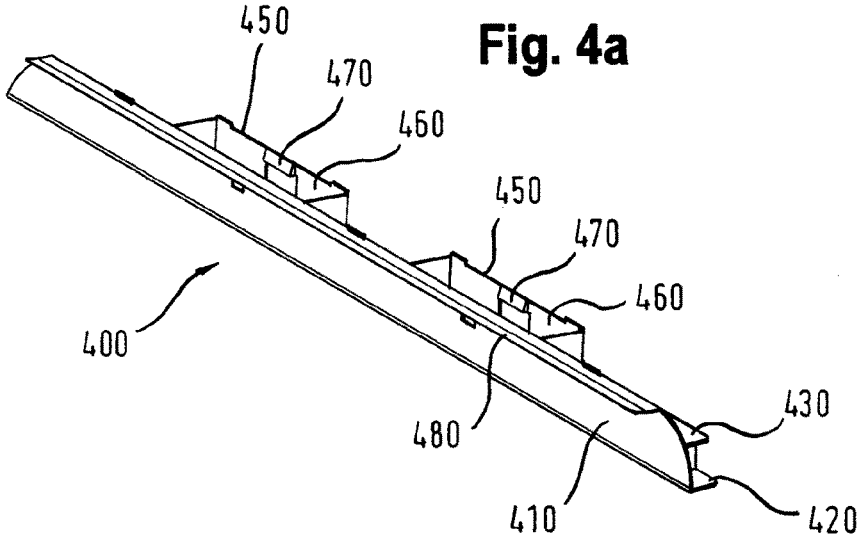
FIG. 4*a* shows a perspective view of a strip for fastening the tube evaporator.
Figure 4B:
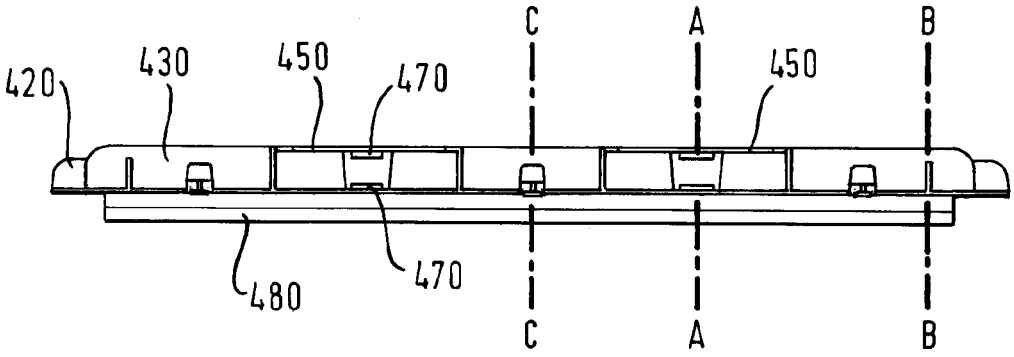
FIG. 4*b* shows a top view of the strip.
Figure 4C:
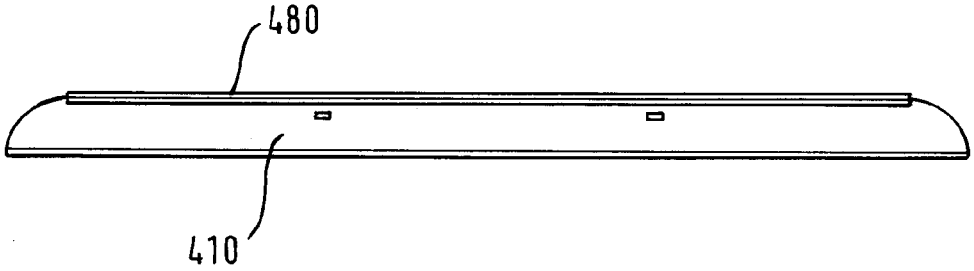
FIG. 4*c* shows a left side view of the strip.
Figure 4D:
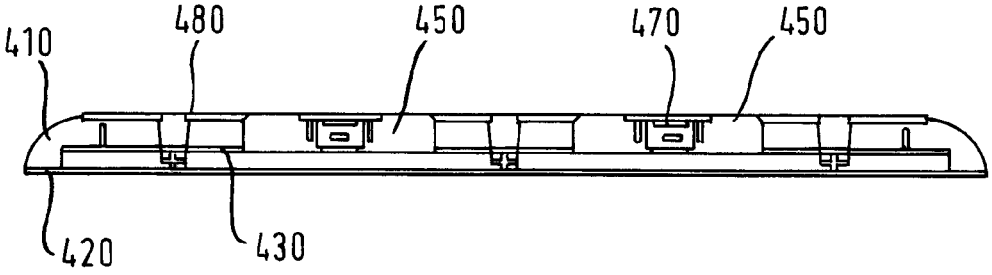
FIG. 4*d* shows a right side view of the strip.
Figure 4E:
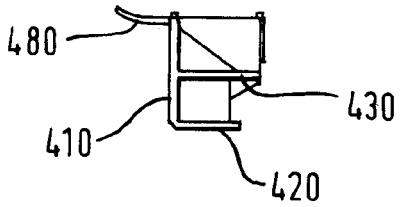
FIG. 4*e* shows a front view of the strip.
Figure 4F:
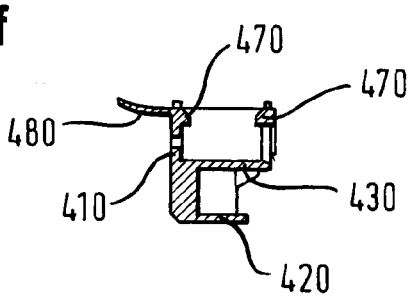
FIG. 4*f* shows a sectional view through the section line A-A in FIG. 4*b*.
Figure 4G:
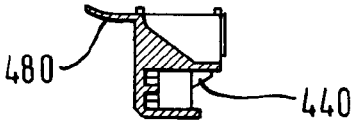
FIG. 4*g* shows a sectional view through the section line B-B in FIG. 4*b*
Figure 4H:
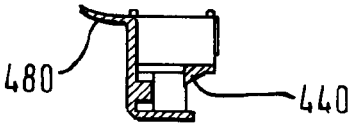
FIG. 4*h* shows a sectional view through the section line C-C in FIG. 4*b*

FIGS. 4*a* to 4*h* show different views of the strip 400 for fastening the second tube evaporator 200. FIG. 4*a* shows a perspective view of the strip 400. FIG. 4*b* shows a top view of the strip 400. FIG. 4*c* shows a left side view of the strip 400. FIG. 4*d* shows a right side view of the strip 400. FIG. 4*e* shows a front view of the strip 400. FIG. 4*f* shows a sectional view through the section line A-A in FIG. 4*b*. FIG. 4*g* shows a sectional view through the section line B-B in FIG. 4*b*. FIG. 4*h* shows a sectional view through the section line C-C in FIG. 4*b*.

The strip 400 comprises a strip rear wall 410, from which a base wall 420 and a center wall 430 project sideways at a distance from one another. The strip rear wall 410, the base wall 420 and the center wall 430 define a recess, in which the second evaporator tube 210 is held and fastened with latching lugs 440. The strip 400 is also provided with two clip holders 450, which are provided at a distance from one another along the strip rear wall 410. These clip holders 450 essentially have the form of a cuboid that is open at the top, its rear wall being formed by the strip rear wall 410 and its base by the center wall 430. A through hole is disposed in the front wall 460 disposed opposite the strip rear wall 410, with a latching lug 470 disposed above said through hole. Disposed opposite said latching lug 470 on the strip rear wall 410 is a further latching lug 470. These latching lugs 470 interact with the limbs of the clips 500 to fasten the strip 400 to the clips 500. A slightly curved, flexible lip 480 projects sideways at the upper end of the strip rear wall 410. When the strip 400 is fastened to the top wall 120, said lip 480 holds the strip against the top wall 120 in a slightly tensioned manner. This compensates for tolerances and prevents the strip flapping against the top wall 120.

Figure 5A:
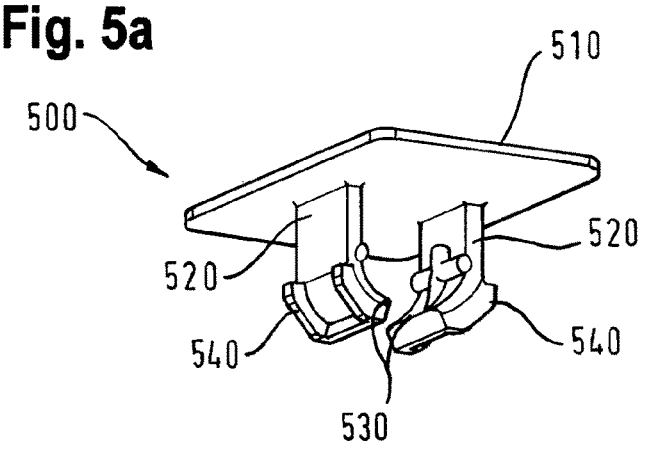
FIG. 5*a* shows a perspective view of a clip for fastening the strip.
Figure 5B:
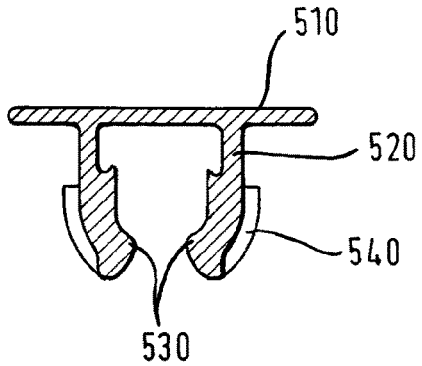
FIG. 5*b* shows a cross-sectional view of the clip for fastening the strip.

FIG. 5*a* shows a perspective view of a clip 500 for fastening the strip 400. FIG. 5*b* shows a cross-sectional view of the clip 500. The clip 500 has an essentially rectangular base plate 510 and two limbs 520, which project from one face of the base plate 510 and are curved toward one another. The limbs 520 are each provided with a latching lug 530, said latching lugs 530 engaging behind the latching lugs 470 on the strip 400 when the strip 400 is clipped to the clips 500, thereby fastening the strip 400 to the top wall 120. The clips 500 can each be approx. 10 to 15 mm high, 35 to 45 mm long and 20 to 25 mm wide.

Figure 6:
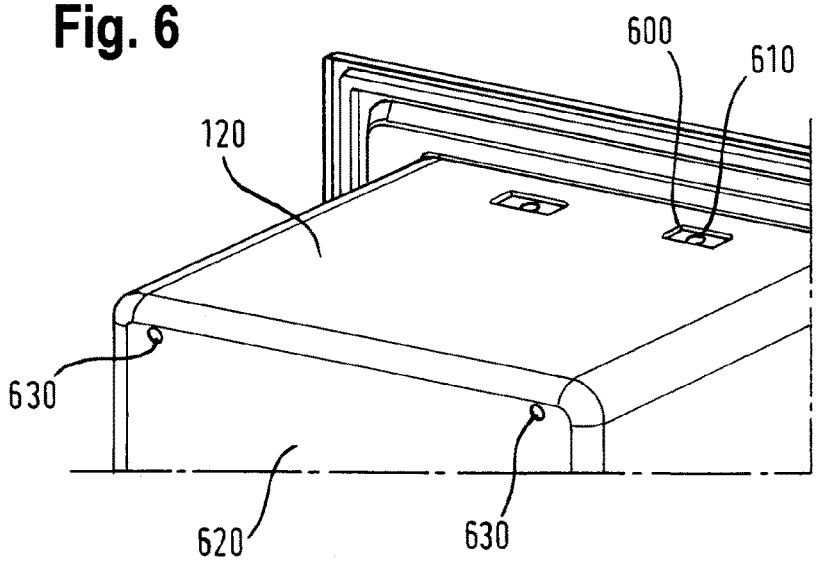
FIG. 6 shows a perspective view of the refrigerated goods container viewed from the rear.

FIGS. 6 to 10 illustrate a method for producing the refrigeration appliance described above. FIG. 6 shows a perspective view of the refrigerated goods container 110 viewed from the rear. Provided at a distance from one another in the top wall 120 are two essentially rectangular depressions 600, into which the clips 500 can be inserted. The size of the depressions 600 corresponds to the size of the base plate 510 of the clips 500 and the depth of the depressions 600 is dimensioned so that when the clips are inserted, the upper face of the base plate 510 adjoins the top wall 120 in an essentially flush manner. Stamped into the top wall 120 in the center of the depressions 600 are through holes 610, through which the limbs 520 of the clips 500 can be passed.

Two further through holes 630 are also stamped on the rear wall 620 of the refrigerated goods container 110 in or close to the top region, it being possible for the ends 230 of the second tube evaporator 200 to pass through them.

Figure 7:
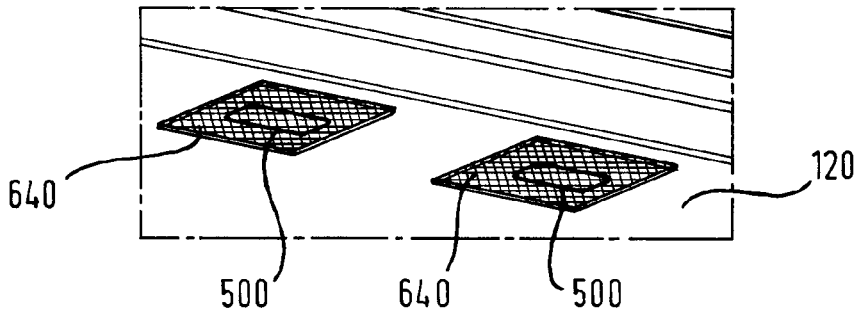
FIG. 7 shows a perspective view of the securing of the clips with adhesive tape.
Figure 8:
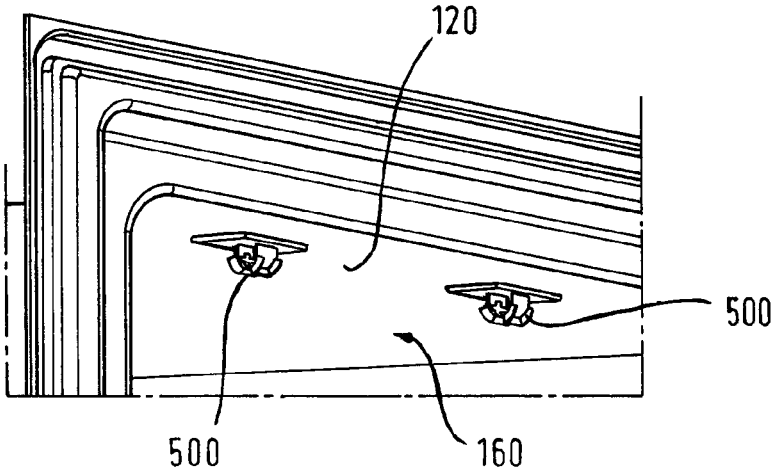
FIG. 8 shows a perspective view of the top region of the refrigerated goods container.

In a first step of the production method the clips 500 are inserted into the depressions 600, the limbs 520 of the clips 500 being passed through the through holes 610, and the clips 500 are secured with adhesive tape 640, as shown in FIG. 7. The situation illustrated in FIG. 8 results, with the clips 500 projecting freely from the top wall 120 into the interior 160 of the refrigerated goods container 110.

In the next step the tube ends 230 of the second tube evaporator 200 are passed through through holes 630 in the rear wall 620 of the refrigerated goods container 110 and the second tube evaporator 200 is clipped to the top wall 120 with the clips 500 at two of its curves. Next the first tube evaporator 130 is wound round the refrigerated goods container 110. The first tube evaporator 130 and the second tube evaporator 200 can then be connected to one another by welding or the like. It should be noted that the first and second tube evaporators 130 and 200 can also be attached in reverse order.

Figure 9:
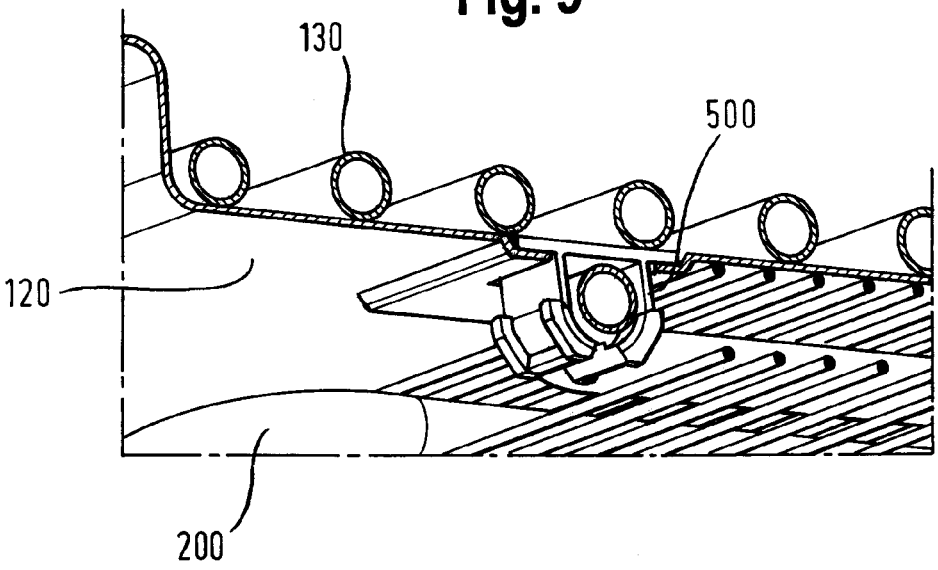
FIG. 9 shows a perspective sectional view through the refrigeration appliance.

The refrigerated goods container 110 is now pushed into an outer housing (not shown in detail) with an appliance outer wall and fixed there. A foam core made of aluminum or the like is also placed in the interior 160 of the refrigerated goods container 110. This foam core serves for stabilization purposes and is dimensioned so that the lower face of the second tube evaporator 200 rests on the upper face of the foam core. This pushes the central tube segments, which have been made rigid by the transverse ribs 220, upward and the upper end of the foam core is disposed between the outermost straight tube segments. In other words in this state the outermost straight tube segments run through a different plane from the central tube segments which, as shown in FIG. 9, are located below the top wall 120, parallel thereto. More specifically, in this state the outer straight tube segments extend from the two through holes in the rear wall at an angle toward the clips 500 disposed in the front region of the refrigerated goods container. The foam core can also brace the rear wall 620 and the side walls of the refrigerated goods container 110 from the inside.

It can also be seen why the transverse ribs 220 do not extend over all the straight tube segments. If they did, the central straight tube segments could not be pushed with the foam core against the upper wall 120.

In the next step the space between the refrigerated goods container 110 and the appliance outer wall is filled with a thermally insulating foam material. As the second tube evaporator 200 rests closely against the top wall 120, it stabilizes the top wall 120 and transmits the pressure produced by the foam application on the top wall 120 to the foam core, preventing the top wall 120 being deformed and bulging. Neither the appliance outer wall nor the thermally insulating foam is shown in the figures for diagrammatic reasons.

Figure 10:
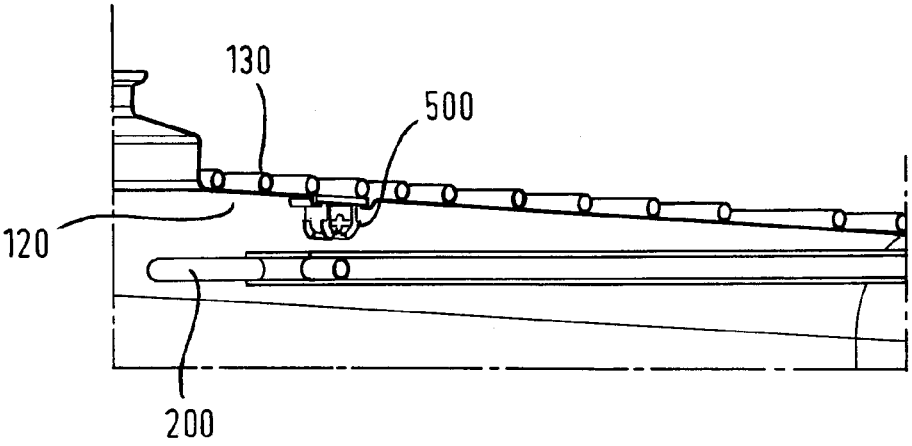
FIG. 10 shows a further perspective sectional view through the refrigeration appliance.

When the foam has been applied, the second tube evaporator 200 is detached from the clips 500 and its front face is lowered slightly, as shown in FIG. 10. The straight tube segments are hereby brought back into one plane. The strip 400 is then positioned on the second tube evaporator 200. More specifically, the second tube evaporator 200 is held in the recess defined by strip rear wall 410, base wall 420 and center wall 430 and fixed with the latching lugs. Finally the strip 400 is clipped or fixed to the clips 500. The state illustrated in FIG. 3 results. The second tube evaporator 200 no longer rests closely against the top wall 120 but is at a distance therefrom, allowing advantageous cold circulation inside the refrigerated goods container 110.

In this state the tube evaporator 200 is fastened by way of the strip 400 at the front and the clips 500 are fastened to the top wall. In the ready to use state the refrigerated goods container 110 can be enclosed on five sides by the appliance outer wall and closed at the front by a door.

With the method described above the same clips 500 are used both for the temporary fixing of the second tube evaporator 200 during the foaming operation and also for the subsequent fastening of the strip 400, so that the refrigeration appliance 100 can be produced with little outlay and little material. Also during the foaming operation the second tube evaporator 200 rests closely against the top wall 120 and stabilizes it, thereby preventing it being deformed and bulging inward as a result of the foam pressure. If the second tube evaporator 200 were already fastened by way of the strip 400 and the clips 500 were already fastened to the top wall 120 during the foaming operation, this would not result in a stabilized space between the second tube evaporator 200 and the top wall 120, so there would be a risk of the top wall 120 being deformed.

All soldering operations can also be performed on the second tube evaporator 200 before the foam application. In particular the output end of the first tube evaporator 130 can be soldered to the input end of the second tube evaporator 200 and a leaktightness check can then be performed before the foam application. However if the second tube evaporator 200 is only inserted after the foam application, an additional step is required to check for leaktightness.

Figure 11:
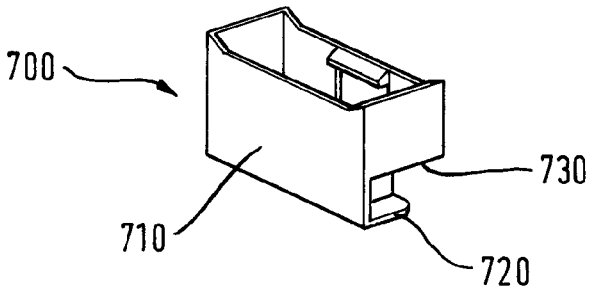
FIG. 11 shows a perspective view of a short strip.

The strip 400 is not limited to the illustrated form described above. For example it is also possible to provide two short strips 700 instead of the strip 400. FIG. 11 shows a perspective view of one of these two short strips 700. The short strips 700 have a rear wall 710 and a base wall 720 and center wall 730 projecting in a perpendicular manner therefrom, which together with the rear wall 710 form a recess for holding a curve of the second tube evaporator 200. Together with two side walls and a front wall the rear wall 710 also forms an essentially cuboid clip holder, which corresponds in form and function essentially to the box-type clip holders 450 of the strip 400. The short strips can be for example approx. 50 mm wide.

Figure 12:
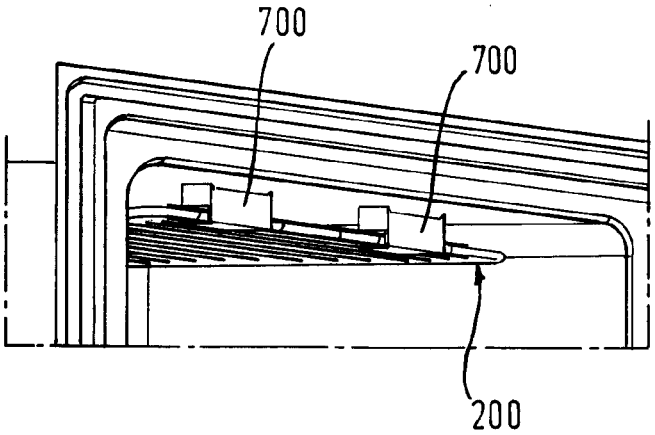
FIG. 12 shows a perspective view of the top region of the refrigerated goods container.

FIG. 12 shows a modified embodiment of a refrigeration appliance, in which the second tube evaporator 200 is fastened to the top wall 120 by means of two short strips 700. This embodiment has the advantage that the short strips 700 are easier to manufacture and also require a smaller material outlay.

The invention claimed is:

1. A refrigeration appliance, comprising:

a refrigerated goods container having an interior within a housing accessible from a front of the housing, the housing having a top wall which is continuous across a depth of the housing;

a first tube evaporator disposed on the refrigerated goods container outside the refrigerated goods container; and a second tube evaporator disposed on the refrigerated goods container inside the interior;

wherein:

the second tube evaporator is disposed proximate to the top wall of the refrigerated goods container;

the second tube evaporator is arranged to be directly exposed to air in the interior of the housing along its entire length;

the second tube evaporator is only a single evaporator within the refrigerated goods container and is disposed in a single horizontal plane;

the second tube evaporator is positioned and configured to cause cool air to be circulated through the container and generate a substantially uniform interior temperature profile; and the first tube evaporator and second tube evaporator are configured to operate simultaneously.

2. The refrigeration appliance of claim 1, wherein the first tube evaporator is wound round the refrigerated goods container.

3. The refrigeration appliance of claim 1, wherein the second tube evaporator is suspended from the top wall.

4. The refrigeration appliance of claim 1, further comprising latching devices fastening the second tube evaporator to the refrigerated goods container.

5. The refrigeration appliance of claim 1, further comprising at least one strip fastened by latching devices to a top wall of the refrigerated goods container at a predefined distance from the top wall of the refrigerated goods container, said second tube evaporator being fastened to the at least one strip.

6. The refrigeration appliance of claim 5, further comprising a further said strip spaced from the at least one strip at a distance from one another, said second tube evaporator being fastened to the top wall by the two strips.

7. The refrigeration appliance of claim 5, wherein the at least one strip has a lip, which is maintained under tension against the top wall.

8. The refrigeration appliance of claim 4, wherein the latching devices are configured as clips.

9. The refrigeration appliance of claim 5, wherein the latching devices are configured as clips.

10. The refrigeration appliance of claim 1, wherein the first tube evaporator and the second tube evaporator are fluidly connected to one another.

11. The refrigeration appliance of claim 1, wherein the first tube evaporator and the second tube evaporator are fluidly connected in a serial manner.

12. The refrigeration appliance according to claim 1, wherein the second tube evaporator is arranged and configured to generate the substantially uniform temperature profile by creating a circulation pattern of cool air within the container.

13. The refrigeration appliance according to claim 1, wherein the second tube evaporator comprises two tube ends which extend to and are disposed through a rear wall of the refrigerated goods container, the tube ends connecting with ends of the first tube evaporator.

14. The refrigeration appliance according to claim 1, wherein the second tube evaporator includes elongate tubes disposed substantially transverse to elongate tubes of the first tube evaporator.

15. The refrigeration appliance of claim 1, wherein the second tube evaporator includes a plurality of tubes extending parallel to the front of the housing.

16. The refrigeration appliance of claim 15, wherein each of the plurality of tubes is directly exposed to air in the interior of the housing along its length.

17. A method for producing a refrigeration appliance having a refrigerated goods container, said method comprising:

disposing a first tube evaporator outside of the refrigerated goods container, the refrigerated goods container having an interior;

disposing a second tube evaporator on the refrigerated goods container inside the interior proximate to a top wall of the refrigerated goods container, the top wall being continuous across a depth of the housing; and configuring and arranging the second tube evaporator to be substantially and directly exposed to air in the interior of the housing along its entire length within the refrigerated goods container so as to cause cool air to circulate through the container and generate a substantially uniform temperature profile within the container, the second tube evaporator is only a single evaporator within the refrigerated goods container and is disposed in a single horizontal plane; and configuring and arranging the first tube evaporator and the second tube evaporator to operate simultaneously.

18. The method of claim 17, wherein the second tube evaporator is fastened to the top wall of the refrigerated goods container by latching devices.

19. The method of claim 18, wherein the latching devices are clips.

20. The method of claim 18, further comprising:

surrounding the refrigerated goods container with a thermally insulating foam material;

after applying the foam, detaching the second tube evaporator from the latching devices;

fastening the second tube evaporator to at least one strip; and fastening the strip by the latching devices.

21. The method of claim 20, further comprising resting the second tube evaporator against a top wall of the refrigerated goods container before surrounding the refrigerated goods container with the thermally insulating foam material.

22. The method of claim 20, further comprising disposing a foam core in the refrigerated goods container while the refrigerated goods container is surrounded with the thermally insulating foam material, and supporting a lower face of the second tube evaporator on the foam core.

23. The method of claim 17, further comprising fluidly connecting the first tube evaporator to the second tube evaporator.

24. The method of claim 17, further comprising fluidly connecting the first tube evaporator to the second tube evaporator in a serial manner.

25. The method of claim 17, wherein the second tube evaporator comprises two tube ends which extend to and are disposed through a rear wall of the refrigerated goods container, the tube ends connected with ends of the first tube evaporator.

26. The method of claim 17, wherein the second tube evaporator includes elongate tubes disposed substantially transverse to elongate tubes of the first tube evaporator.

27. A refrigeration appliance, comprising:

a refrigerated goods container having an interior within a housing accessible from a front of the housing, the housing having a top wall which is continuous across a depth of the housing;

a first tube evaporator disposed on the refrigerated goods container outside of the refrigerated goods container; and a second tube evaporator arranged with an overall horizontal orientation disposed within the refrigerated goods container inside the interior proximate to the top wall;

wherein the second tube evaporator is only a single evaporator within the refrigerated goods container and is disposed in a single horizontal plane; and wherein the second tube evaporator is directly and substantially exposed to air in the interior along its entire length and is configured to cause cool air to be circulated through the container and generate a substantially uniform interior temperature profile during operation.

28. The refrigeration appliance according to claim 27, wherein the second tube evaporator comprises a plurality of tube segments and at least one bend connecting the plurality of tube segments.

29. The refrigeration appliance according to claim 27, wherein the second tube evaporator comprises two tube ends which extend to and are disposed through a rear wall of the refrigerated goods container, the tube ends connected with ends of the first tube evaporator.

30. The refrigeration appliance according to claim 27, wherein the second tube evaporator includes elongate tubes disposed substantially transverse to elongate tubes of the first tube evaporator.

31. The refrigeration appliance according to claim 28, further comprising at least one rib transversely fastened to the plurality of tube segments, wherein the at least one rib is not connected to at least one of the tube segments, thereby allowing rotation of the at least one of the tube segments relative to the remaining tube segments.

32. The refrigeration appliance of claim 27, wherein the second tube evaporator includes a plurality of tube segments each directly and substantially exposed to air in the interior.

* * * * *